US010612878B1

(12) United States Patent
Salvador

(10) Patent No.: US 10,612,878 B1
(45) Date of Patent: Apr. 7, 2020

(54) MUZZLE DEVICE, FIREARM BARREL, AND METHOD OF ATTACHMENT

(71) Applicant: Savage Arms, Inc., Westfield, MA (US)

(72) Inventor: Joseph D. Salvador, Wilbraham, MA (US)

(73) Assignee: Savage Arms, Inc., Westfield, MA (US)

( * ) Notice: Subject to any disclaimer, the term of this patent is extended or adjusted under 35 U.S.C. 154(b) by 0 days.

(21) Appl. No.: 16/123,448

(22) Filed: Sep. 6, 2018

(51) Int. Cl.
*F41C 7/00* (2006.01)
*F41A 21/32* (2006.01)
*F41A 21/36* (2006.01)

(52) U.S. Cl.
CPC ..... *F41A 21/325* (2013.01); *F41A 21/36* (2013.01)

(58) Field of Classification Search
CPC ..... F41A 21/325
See application file for complete search history.

(56) References Cited

U.S. PATENT DOCUMENTS 2,870,679 A * 1/1959 Collins ..... F41A 21/34 89/14.2
4,429,614 A * 2/1984 Tocco ..... F41A 21/36 89/14.3
4,510,843 A 4/1985 Rabatin
4,939,977 A 7/1990 Stroup
4,945,812 A * 8/1990 Mazzanti ..... F41A 21/36 89/14.3
6,385,891 B1 5/2002 Rabatin
7,353,740 B1 4/2008 Hoffman
8,210,087 B2 7/2012 Latka
8,973,481 B2 3/2015 Dueck et al.
9,182,187 B1 11/2015 Griffith
9,500,427 B1 11/2016 Larue
9,513,078 B1 12/2016 Fulton et al.
9,709,355 B2 * 7/2017 Joplin ..... F41A 21/36
9,739,560 B1 8/2017 Salvador
9,921,021 B1 * 3/2018 Graham, II ..... F41A 21/325
2008/0156183 A1 7/2008 Brittingham
2009/0107325 A1 4/2009 Poulsen
2009/0193963 A1 8/2009 Poulsen
2010/0050493 A1 3/2010 Joseph et al.
2014/0237881 A1 8/2014 Mack
2015/0253098 A1 9/2015 Russell et al.
2016/0097609 A1 4/2016 Penchuk
2016/0202013 A1 * 7/2016 Lessard ..... F41A 21/325 89/14.3
2017/0184367 A1 6/2017 Odle et al.
(Continued)

*Primary Examiner* — Gabriel J. Klein
(74) *Attorney, Agent, or Firm* — Christensen, Fonder, Dardi & Herbert PLLC

(57) ABSTRACT

A firearm barrel configured to attach to a muzzle device including a muzzle device bore and a tapered interior surface tapering from a first, wider portion at a proximal end of the muzzle device to a second, narrower portion away from the proximal end. The firearm barrel includes a barrel bore, a first, proximal end, a second, distal end, and a tapered exterior surface tapering from a first, wider portion to a second, narrower portion towards the distal end of the barrel, wherein the tapered exterior surface is configured to operably mate with the tapered interior surface of the muzzle device to optimize axial alignment of the barrel bore with the muzzle device bore.

12 Claims, 7 Drawing Sheets

(56) References Cited

U.S. PATENT DOCUMENTS

| | | | |
|---|---|---|---|
| 2017/0205176 | A1 | 7/2017 | Whitson |
| 2017/0241733 | A1 | 8/2017 | Salvador |
| 2017/0292806 | A1 | 10/2017 | Gangl |
| 2018/0017352 | A1 | 1/2018 | Addis |

* cited by examiner

MUZZLE DEVICE, FIREARM BARREL, AND METHOD OF ATTACHMENT

FIELD

The present disclosure generally relates to firearms and, more particularly, to firearm barrels and muzzle devices that can be mounted on firearm barrels.

BACKGROUND OF THE DISCLOSURE

Presently, muzzle devices, such as muzzle brakes, recoil compensators, sound suppressors, flash hiders, and blank firing adapters, are attached to and retained by threads formed in a distal end of a firearm barrel. A separate locating or alignment feature is often included to align the bores of the firearm barrel and muzzle device. By requiring such location features, in addition to threads, however, can be multiple areas of manufacturing tolerance stack-up. This can cause the bore of the muzzle device to be off axis relative to the bore of the firearm, which can result in a bullet strike on the muzzle device itself. To counter this, the bore of the muzzle brake or compensator often must be made larger than the barrel bore to provide clearance needed to offset the manufacturing tolerance stack-up, which is not optimal in that it can reduce the performance and accuracy of the firearm. Additionally, the manufacturing tolerance stack-up can present further locations for build-up of carbon and other debris, thus making removal of muzzle devices difficult.

SUMMARY

Embodiments of the present disclosure can include a tapered exterior surface at a distal end of a barrel—from a wider diameter proximal a user to a narrower diameter distal a user—enhancing alignment, protecting the threads from fouling, and allowing for backwards compatibility for legacy muzzle devices. The tapered exterior surface enables a user to reduce the number of tolerance stack-ups, such as down to one or two, and these interfaces can be held to a much tighter tolerance in manufacturing than threaded features. Additional features and advantages of embodiments of the present disclosure include the following.

The configuration of the tapered interface between the rifle barrel and muzzle device according to embodiments of the present disclosure can help to better align the muzzle and barrel bores and the threads can be used for both retention and alignment of the muzzle device—negating the need for secondary alignment components.

With the configuration of the tapered interface between the rifle barrel and muzzle device according to embodiments of the present disclosure, tolerance stack-ups in the attachment of a muzzle device to a firearm barrel can be reduced. With prior barrels and muzzle devices, the number of interfaces between two or more parts increases, the more tolerance variations can build up. When dealing with firearms, such stack-ups could lead to misalignment of barrel and muzzle device bores. In contrast, in the embodiments of the present disclosure, by limiting interfaces, the number of locations where dirt, gunpowder, and other residue build up are limited, which can also reduce or eliminate thread fouling.

The configuration of the tapered interface between the rifle barrel and muzzle device according to embodiments of the present disclosure can help to maximize backwards compatibility for legacy muzzle devices by the tapered portion of the interface being smaller in diameter than an internal bore of preexisting or legacy muzzle devices thus enabling the tapered portion to fit into the larger bore of the legacy muzzle device.

The configuration of the tapered interface between the rifle barrel and muzzle device according to embodiments of the present disclosure can enable simultaneous clocking of the muzzle device and tightening of the muzzle device to the rifle barrel by having the two threaded interfaces threaded in opposite directions, i.e., having reverse threading wherein one threaded connection is right-handed and one is left-handed.

In a first embodiment, wherein a firearm barrel is configured to attach to a muzzle device including a muzzle device bore and a tapered interior surface tapering from a first, wider portion at a proximal end of the muzzle device to a second, narrower portion away from the proximal end, the firearm barrel includes a barrel bore, a first, proximal end, a second, distal end, and a tapered exterior surface tapering from a first, wider portion to a second, narrower portion towards the distal end of the barrel, wherein the tapered exterior surface is configured to operably mate with the tapered interior surface of the muzzle device to optimize axial alignment of the barrel bore with the muzzle device bore.

In a second embodiment, the firearm barrel of the first embodiment further includes barrel threads proximal the tapered exterior surface, such that the tapered exterior surface tapers from the first, wider portion to the second, narrower portion away from the barrel threads.

In a third embodiment, the muzzle device includes a nut including a first set of interior threads configured to threadably engage the barrel threads, such that when the first set of interior threads are threadably engaged with the barrel threads, the tapered exterior surface mates with the tapered interior surface of the muzzle device to optimize axial alignment of the barrel bore with the muzzle device bore.

In a fourth embodiment, the muzzle device includes exterior threads at the proximal end of the muzzle device and the nut includes a second set of interior threads distal the first set of interior threads, wherein the exterior threads of the muzzle device are configured to threadably engage the second set of interior threads.

In a fifth embodiment, the first set of interior threads and barrel threads are threaded in a first direction and the muzzle device exterior threads and second set of interior threads are threaded in a second direction, opposite the first direction.

In a sixth embodiment, the first set of interior threads and barrel threads are right-hand threaded and the muzzle device exterior threads and second set of interior threads are left-hand threaded.

In a seventh embodiment, the tapered interior surface of the muzzle device and the tapered exterior surface of the barrel each includes a length, wherein the lengths are substantially the same.

In an eighth embodiment, wherein a muzzle device is configured for use with a firearm barrel having a barrel bore, a threaded muzzle, and a tapered exterior surface proximate a distal end of the barrel tapering from a first, wider portion to a second, narrower portion at the distal end, the muzzle device includes a muzzle device body and a neck extending proximally from the muzzle device body, wherein the neck includes external threads and a tapered interior surface tapering from a first, wider portion at a proximal end of the neck to a second, narrower portion away from the proximal end of the neck, a nut including a first set of interior threads proximate a distal end of the nut threadably engaged with the external threads of the muzzle device, and a second set of interior threads proximal the first set of interior threads, wherein the second set of interior threads are configured to threadably engage the barrel threads, such that when the second set of interior threads are threadably engaged with the barrel threads, the tapered exterior surface mates with the tapered interior surface of the muzzle device to optimize axial alignment of the barrel bore with the muzzle device bore.

In a ninth embodiment, the first set of interior threads and barrel threads are threaded in a first direction and the muzzle device exterior threads and second set of interior threads are threaded in a second direction, opposite the first direction.

In a tenth embodiment, the first set of interior threads and barrel threads are right-hand threaded and the muzzle device exterior threads and second set of interior threads are left-hand threaded.

In an eleventh embodiment, a method for attaching a muzzle device to barrel includes providing a muzzle device including a muzzle device bore and a muzzle device tapered interior surface tapering from a first, wider portion at a proximal end thereof to a second, narrower portion away from the proximal end, providing a barrel having a barrel bore, a threaded muzzle, and a tapered exterior surface proximate a distal end of the barrel tapering from a first, wider portion to a second, narrower portion at the distal end, and operably coupling the muzzle device and barrel such that the tapered interior surface of the muzzle device mates with the tapered exterior surface of the barrel to optimize axial alignment of the barrel bore with the muzzle device bore.

In a twelfth embodiment, the barrel further includes barrel threads proximal the tapered exterior surface, such that the tapered exterior surface tapers from the first, wider portion to the second, narrower portion away from the barrel threads, and wherein the muzzle device includes a nut including a first set of interior threads configured to threadably engage the barrel threads. The method further includes threadably engaging the first set of interior threads with the barrel threads, such that the tapered exterior surface mates with the tapered interior surface of the muzzle device to optimize axial alignment of the barrel bore with the muzzle device bore.

In a thirteenth embodiment, the muzzle device includes exterior threads at the proximal end of the muzzle device and the nut includes a second set of interior threads distal the first set of interior threads. The method further includes threadably engaging the exterior threads of the muzzle device to the second set of interior threads.

The above summary is not intended to describe each illustrated embodiment or every implementation of the present disclosure.

DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
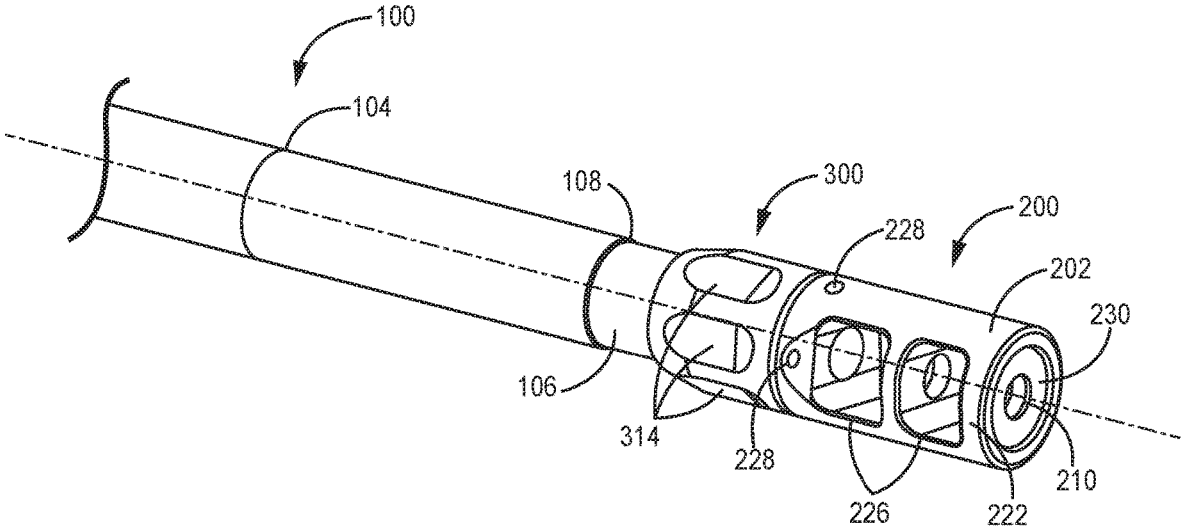
FIG. 1 is a front perspective view of a firearm barrel and muzzle device according to an embodiment of the present disclosure.

While the embodiments of the disclosure are amenable to various modifications and alternative forms, specifics thereof have been shown, by way of example, in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 2:
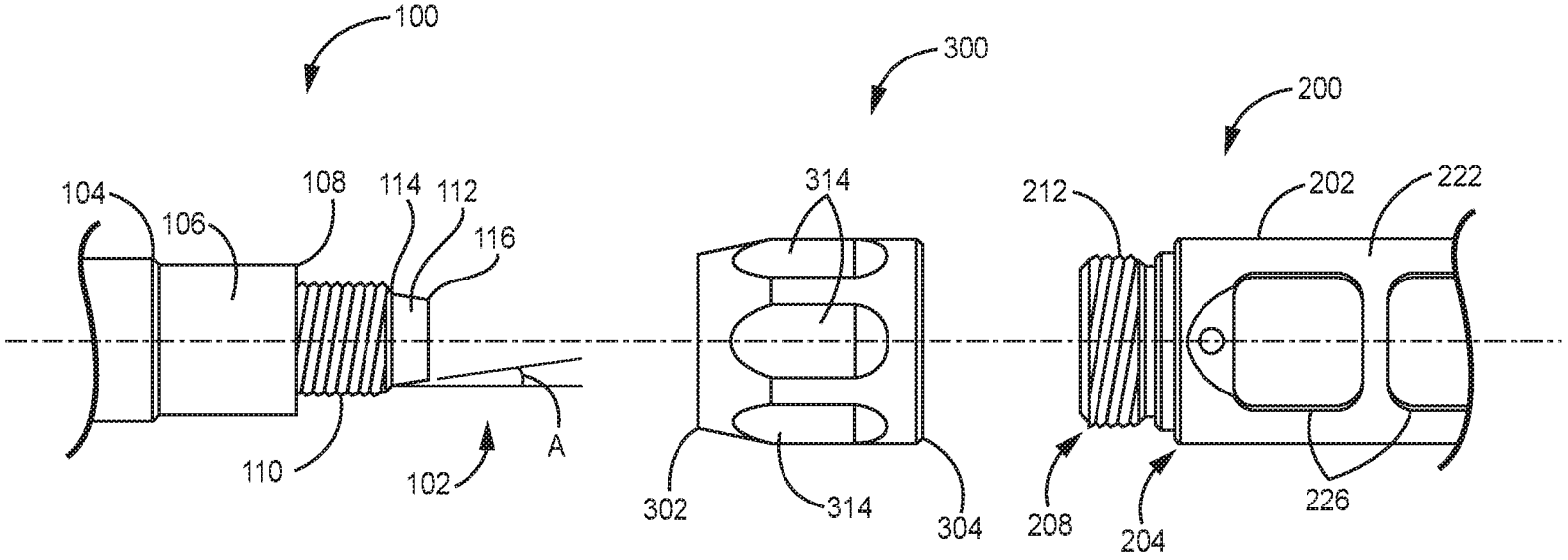
FIG. 2 is an exploded side elevational view of a barrel and muzzle device according to an embodiment of the present disclosure.
Figure 3:
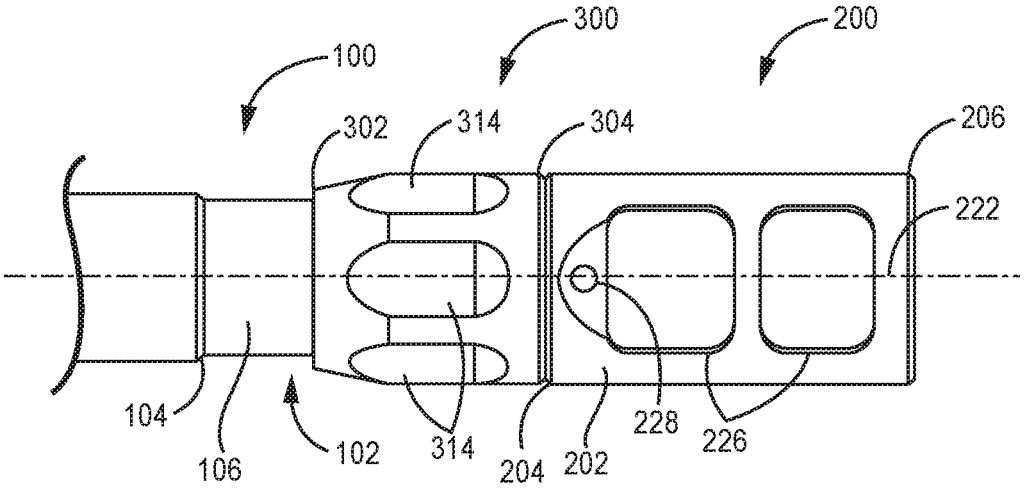
FIG. 3 is a side elevational view of a barrel and muzzle device according to an embodiment of the present disclosure.
Figure 4:
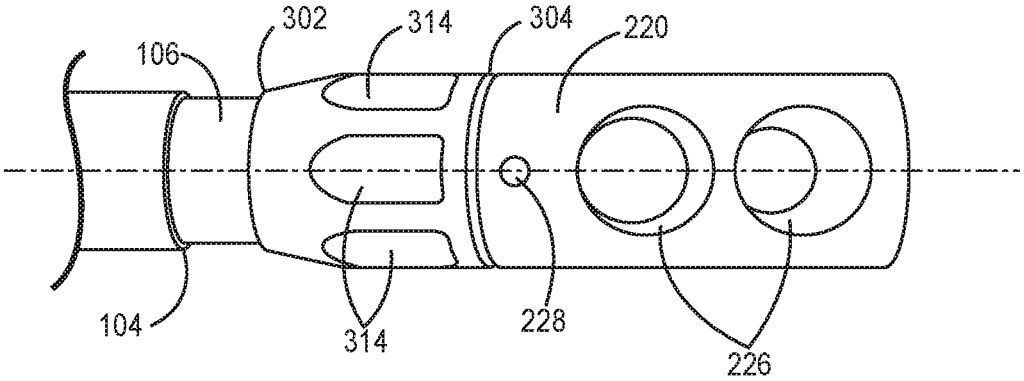
FIG. 4 is a top plan view of a barrel and muzzle device according to an embodiment of the present disclosure.

Referring to FIGS. 1 and 2, a firearm barrel 100, muzzle device 200, and nut 300 according to an embodiment are depicted.

In the context of this disclosure, unless otherwise specifically noted, the terms "proximal," "proximally," proximally located," "distal," "distally," and "distally located," are used in a way relative to a user of a firearm. By way of example, the stock of a firearm is on the proximal end of the firearm and the end of the barrel is on the distal end of the firearm.

Barrel 100 includes a first, proximal end (not depicted) and a second, distal end 102—sometimes referred to as the "muzzle" end. Distal end 102 includes a first shoulder 104, an exterior surface 106, a second shoulder 108, and barrel threads 110 formed, such as by machining, into distal end 102 and distal relative to second shoulder 108. Distal end 102 of barrel 100 further includes a tapered exterior surface 112 distal relative to barrel threads 110 tapering from a first, wider portion 114 to a second, narrower portion 116 when moving towards the distal end 102 of barrel 100. Barrel further includes a barrel bore 118 defined therein extending along a length thereof from proximal end (not depicted) to distal end 102 (see FIG. 5). Barrel 100 can be constructed of a medium-carbon steel having a hardness of at least about 28 HRC, such as Grades AISI 4140 or 4142, although other materials, such as stainless steels, can be used.

In an embodiment, barrel threads 110 are ½"—28 UNEF Screw Threads per ANSI B1.1, although other threads can be used. In an embodiment, a length of barrel threads 110 is about $^{400}/_{1000}$ of an inch. In an embodiment, a length of tapered exterior surface 112 is about $^{200}/_{1000}$ of an inch. Referring to FIG. 2, in an embodiment, an angle "A" of tapered exterior surface 112 relative to a longitudinal axis of barrel bore 118 is from about three degrees (3°) to about thirty degrees (30°). In a preferred embodiment, angle "A" of tapered exterior surface 112 is from about ten degrees (10°) to about eighteen degrees (18°). In an optimal embodiment, angle "A" of tapered exterior surface 112 is about fourteen degrees (14°). Angle "A" of tapered exterior surface 112 relative to an axis of barrel bore 118 is selected to optimize self-releasing and self-locking properties of muzzle device 200. In other words, as will be described below, when muzzle device 200 is attached to barrel 100, tapered exterior surface 112 mates with a tapered interior device of the muzzle device. The angle of tapered exterior surface 112 (and the tapered interior surface of muzzle device) is chosen to as to be as tight as possible, but still enable releasing, and as loose as possible, but still enable engagement.

Figure 5:
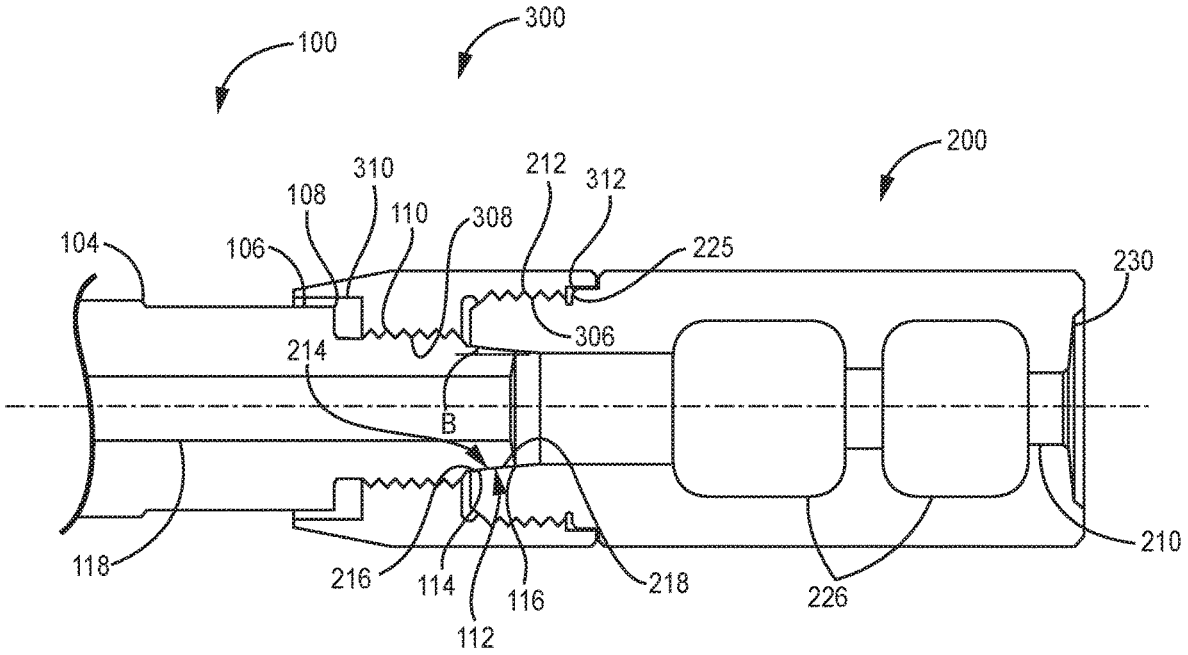
FIG. 5 is a side cross-sectional view of a barrel and muzzle device according to an embodiment of the present disclosure.
Figure 6:
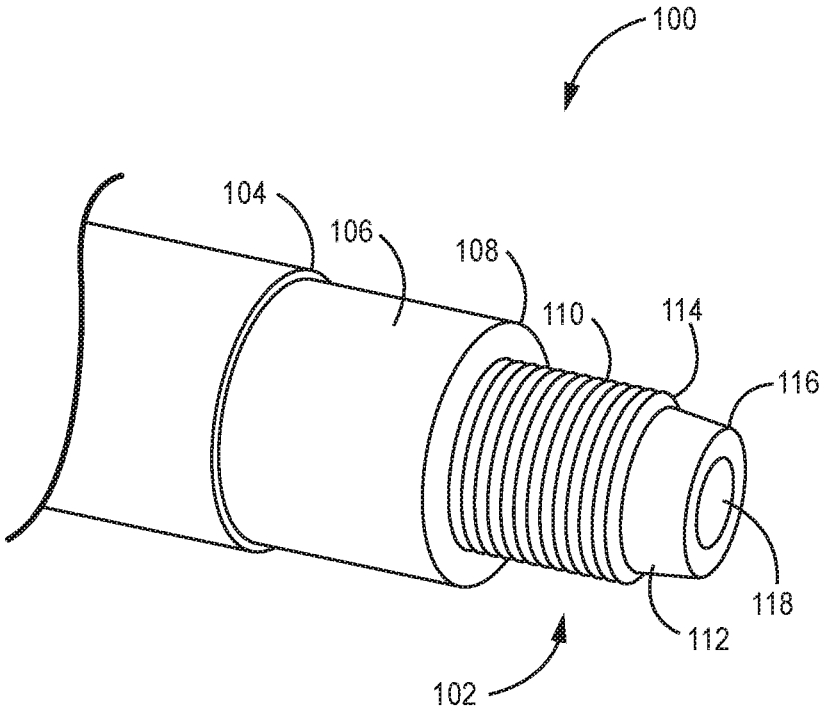
FIG. 6 is a front perspective view of a firearm barrel according to an embodiment of the present disclosure.
Figure 7:
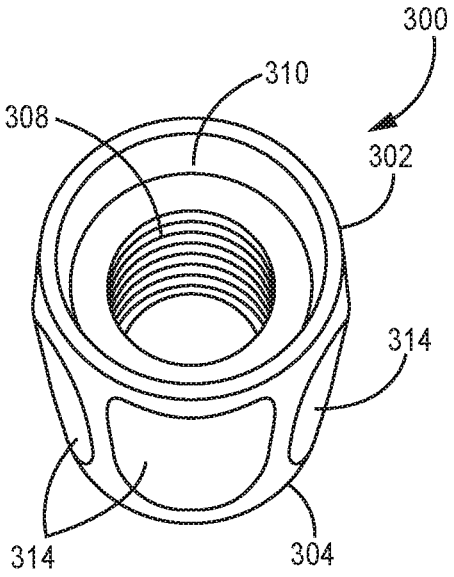
FIG. 7 is a perspective view of a proximal end of a nut of a muzzle device according to an embodiment of the present disclosure.
Figure 8:
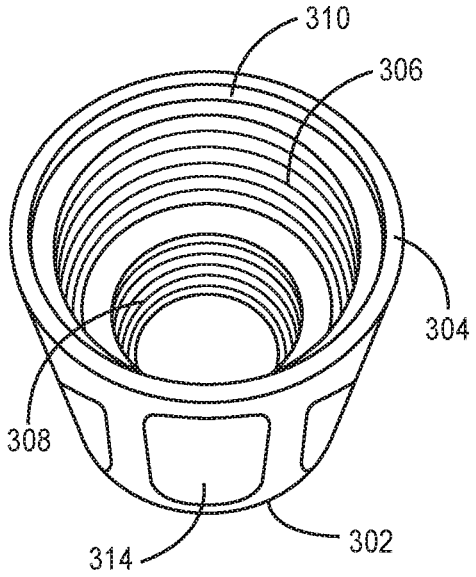
FIG. 8 is a perspective view of a distal end of a nut of a muzzle device according to an embodiment of the present disclosure.
Figure 9:
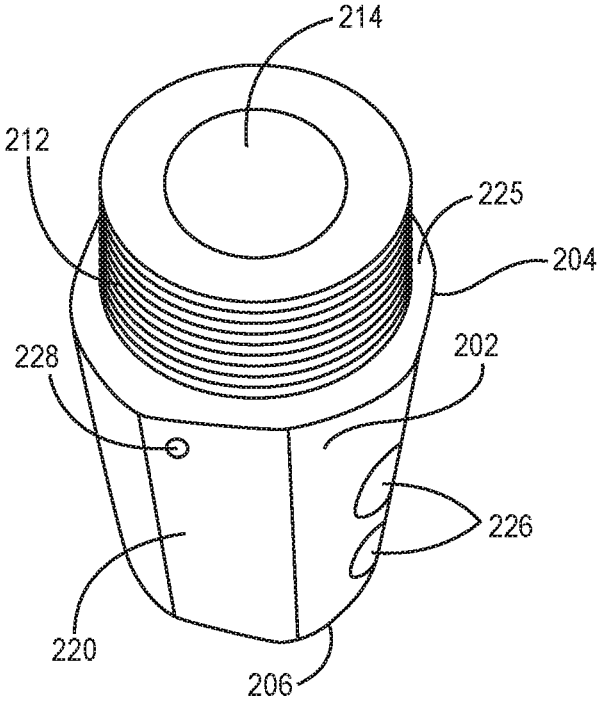
FIG. 9 is a perspective view of a distal end of a muzzle device according to an embodiment of the present disclosure.

Referring to FIGS. 1-5, muzzle device 200 includes a muzzle device body 202 including a first, proximal end 204 and a second, distal end 206, a neck 208 extending proximally from first, proximal end 202 of muzzle device body 200, and a muzzle device bore 210 axially extending through muzzle device body 202 and neck 208. Neck 208 includes external threads 212 and a tapered interior surface 214 tapering from a first, wider portion 216 at a proximal end of neck 208 to a second, narrower portion 218 away from the proximal end of neck 208. Referring to FIG. 5, an angle "B" of tapered interior surface 214 relative to an axis of muzzle device bore 210 is from about three degrees (3°) to about thirty degrees (30°). In a preferred embodiment, angle "B" of tapered interior surface 214 is from about ten degrees (10°) to about eighteen degrees (18°). In an optimal embodiment, angle "B" of tapered interior surface 214 is about fourteen degrees (14°).

Referring to FIGS. 2-5 and 9, muzzle device 200 further includes a first flat surface 220 (oriented as a top surface when on a firearm), a second flat surface not depicted in the figures (oriented as a bottom surface when on a firearm) substantially parallel to first flat surface 220. Muzzle device further includes a first side surface 222 and a second side surface 224. First side 222 and second side 224 can include a plurality of baffles or baffle ports 226. A plurality of gas jets or ports can also be included on muzzle device. As depicted, two gas ports 228 are included on muzzle device—one on first flat surface 220 (top) and one on first side 222. Gas ports 228 can inhibit muzzle climb and reduce the tendency of the firearm to rise. Flat surfaces 220 on top and bottom of muzzle device 200 can be used for tightening muzzle device 200 with a wrench or other tool. Referring to FIG. 5, muzzle device 200 can include a shoulder or flange 225 proximate muzzle device threads 212 that can correspond to an interior surface of distal end of nut 300, described in further detail below. Muzzle device 200 can further include a recess 230 in distal end 206.

Referring to FIGS. 1-5, 7, and 8, nut 300 can be generally annular in shape, including a first, proximal end 302 a second, distal end 304, and includes a first set of interior threads 306 proximate distal end 304 of nut 300 that can be threadably engaged with external threads 212 of muzzle device 200. Nut 300 further includes a second set of interior threads 308 proximally located relative to the first set of interior threads 306. An interior surface 310 of nut 300 can be included proximal second set of interior threads 306 that can include a diameter slightly larger than annular exterior surface 106 of barrel 100 and an interior surface 312 on distal end 304 of nut 300. Second set of interior threads 308 are configured to threadably engage barrel threads 110. Nut 300 can include a plurality of flat surfaces 314 (six depicted for a standard hexagonal design) for tightening nut 300 with a wrench or other tool.

Muzzle device 200 and nut 300 can be constructed of a medium-carbon, such as AISI 4140 or 4142, although other materials, such as stainless steels, can be used to form muzzle device 200.

While muzzle device 200 and nut 300 are generally referred to separately herein, muzzle device 200 can include nut 300—i.e., nut 300 can be part of muzzle device 200.

In an embodiment, to install muzzle device 200 on barrel 100, muzzle device 200 can be coupled with nut 300 by threading muzzle device exterior threads 212 and second set of interior threads 308 of nut 300 together. In an embodiment, muzzle device exterior threads 212 and second set of interior threads 308 are left-hand threaded. In other embodiments, muzzle device exterior threads 212 and second set of interior threads 308 are right-hand threaded. Next, nut 300 can be coupled with barrel 100 by threading first set of interior threads 306 of nut 300 and barrel threads 110 together. In an embodiment, first set of interior threads 306 and barrel threads 110 are right-hand threaded. In others, first set of interior threads 306 and barrel threads 110 are left-hand threaded. When this is done, tapered exterior surface 112 of barrel 100 operably mates with tapered interior surface 214 of muzzle device 200 to optimize axial alignment of barrel bore 118 with muzzle device bore 210.

In another embodiment, nut 300 can first be coupled with barrel 100 by threading first set of interior threads 306 and barrel threads 110 together. In an embodiment, first set of interior threads 306 and barrel threads 110 are right-hand threaded. Next, muzzle device 200 can be coupled with nut 300 by threading muzzle device exterior threads 212 and second set of interior threads 308 together. In an embodiment, muzzle device exterior threads 212 and second set of interior threads 308 are left-hand threaded. When this is done, tapered exterior surface 112 of barrel 100 operably mates with tapered interior surface 214 of muzzle device 200 to optimize axial alignment of barrel bore 118 with muzzle device bore 210.

Once connected, both pairs of threads 306/110 and 212/308 can be adjusted such that muzzle device 200 is properly secured to barrel 100 and muzzle device 200 is in the proper orientation and barrel bore 118 and muzzle device bore 210 are in alignment. By way of example, in an embodiment wherein muzzle device 200 includes gas port 228 on top flat surface 220, muzzle device 200 can be rotationally adjusted such that gas port 228 on top flat surface 220 is oriented upwards.

When installed, shoulder 200 can operably engages interior surface 311 of distal end 304 of nut 300, such that any gaps are hidden, inhibiting any dirt, gunpowder, or other residue from getting into muzzle device exterior threads 212 and second set of interior threads 308 of nut 300. Also, a gap between interior surface 311 of distal end 304 of nut 300 proximal second set of interior threads 308 and exterior surface 106 of barrel 100 is also such that the ingression of any dirt, gunpowder, or other residue into first set of interior threads 306 of nut 300 and barrel threads 110 is inhibited.

While the present disclosure and embodiments described herein have related to a muzzle brake, other muzzle devices can be used, including, by way of example, sound suppressors, flash hiders, and blank firing adapters.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A firearm barrel configured to attach to a muzzle device, in combination with the muzzle device, said barrel having:

a barrel bore;

a first, proximal end;

a second, distal end; and a frustoconical exterior surface tapering from a first, wider portion to a second, narrower portion at said distal end of the barrel, wherein said frustoconical exterior surface is configured to operably mate with a tapered interior surface of the muzzle device, the barrel further having external barrel threads proximal said frustoconical exterior surface;

the muzzle device having a muzzle device body and a unitary neck extending proximally from the muzzle device body, the muzzle device having a muzzle device bore, the neck having the tapered interior surface tapering from a first, wider portion at a proximal end of the muzzle device to a second, narrower portion away from said proximal end, wherein the tapered interior surface is configured to operably mate with the frustoconical exterior surface of the barrel, the neck further having external neck threads;

the muzzle device further comprising a nut, the nut having a first set of interior threads for engaging with the external barrel threads, and a second set of interior threads for engaging with the external neck threads;

whereby when the muzzle device is engaged with the barrel, the contact of the barrel with the muzzle device body and neck is exclusively at an engagement of the frustoconical exterior surface of the barrel and the tapered interior surface of the neck and the nut is threadably engaged with the external barrel threads and external neck threads.

2. The firearm barrel in combination with the muzzle device of claim 1, wherein the first set of interior threads and barrel threads are threaded in a first direction and said muzzle device exterior threads and second set of interior threads are threaded in a second direction, opposite said first direction.

3. The firearm barrel in combination with the muzzle device of claim 1, wherein the first set of interior threads and barrel threads are right-hand threaded and said muzzle device exterior threads and second set of interior threads are left-hand threaded.

4. The firearm barrel in combination with the muzzle device of claim 1, wherein the tapered interior surface of the muzzle device and the frustoconical exterior surface of the barrel each comprise a length, wherein the lengths are substantially the same.

5. The firearm with a muzzle device of claim 1, wherein an angle of the frustoconical exterior surface to a longitudinal axis of the barrel is from 3° to about 30°, and wherein an angle of the tapered interior surface to a longitudinal axis of a bore of the muzzle is from 3° to about 30°.

6. The firearm with a muzzle device of claim 1, wherein the muzzle device comprises only two components: the nut and the muzzle device body with the unitary neck.

7. A firearm with a muzzle device, the firearm comprising a monolithic barrel with a distal end having a barrel tapered surface and barrel exterior threads, the muzzle device comprising a muzzle device body with a unitary neck extending from the body, the neck having a muzzle device tapered surface that mates with the barrel tapered surface and further having external muzzle device threads, the muzzle device further comprising a nut being threaded with internal threads, including threads for engaging with the barrel external threads and threads for engaging with the external muzzle device threads, wherein the distal end of the barrel is threadably engageable with the nut and not with the muzzle body and neck, and wherein the neck is threadably engageable with the nut and not with the barrel external threads, the barrel tapered surface directly mates with the muzzle device tapered surface to optimize axial alignment of a bore of the barrel bore with a bore of the muzzle device, whereby when the muzzle device is engaged with the barrel, the contact of the barrel with the muzzle device body and neck is exclusively at an engagement of the tapered exterior surface of the barrel and the tapered interior surface of the neck and the nut is threadably engaged with the external barrel threads and external neck threads.

8. The firearm with the muzzle device of claim 7, wherein the internal threads of the nut comprise a first set of interior threads threaded in a first direction for engaging with the barrel external threads and further comprise a second set of interior threads threaded in a second direction, opposite the first direction, for engaging the muzzle device external threads.

9. The firearm with muzzle device of claim 7, wherein when the barrel tapered surface directly mates with the muzzle device tapered surface, the contact between the barrel and the muzzle device and unitary neck is exclusively at the respective tapered surfaces.

10. The firearm with a muzzle device of claim 7, wherein the barrel is threadably connected only to the nut, and the muzzle device body with unitary neck is threadably connected only to the nut.

11. The firearm with a muzzle device of claim 7, wherein an angle of the barrel tapered surface to a longitudinal axis of the barrel is from 3° to about 30°, and wherein an angle of the muzzle device tapered surface to a longitudinal axis of a bore of the muzzle is from 3° to about 30°.

12. The firearm with a muzzle device of claim 7, wherein the muzzle device comprises only two components: the nut and the muzzle device body with the unitary neck.

* * * * *